US010702742B2

(12) United States Patent
Sharma et al.

(10) Patent No.: US 10,702,742 B2
(45) Date of Patent: Jul. 7, 2020

(54) MULTI-FUNCTIONAL EXERCISE DEVICE

(71) Applicants: Sheshadri Sharma, Irvine, CA (US); Aneesh S Sharma, Irvine, CA (US)

(72) Inventors: Sheshadri Sharma, Irvine, CA (US); Aneesh S Sharma, Irvine, CA (US)

(73) Assignee: Sheshadri Sharma, Irvine, CA (US)

( * ) Notice: Subject to any disclaimer, the term of this patent is extended or adjusted under 35 U.S.C. 154(b) by 103 days.

(21) Appl. No.: 16/170,031

(22) Filed: Oct. 25, 2018

(65) Prior Publication Data

US 2020/0129807 A1 Apr. 30, 2020

(51) Int. Cl.

| | |
|---|---|
| ***A63B 23/16*** | (2006.01) |
| ***A63B 21/00*** | (2006.01) |
| ***A63B 21/055*** | (2006.01) |

(52) U.S. Cl.

CPC ..... *A63B 23/16* (2013.01); *A63B 21/0555* (2013.01); *A63B 21/0557* (2013.01); *A63B 21/4019* (2015.10); *A63B 21/4043* (2015.10); *A63B 2225/20* (2013.01); *A63B 2225/50* (2013.01)

(58) Field of Classification Search

CPC . A63B 23/16; A63B 21/0555; A63B 21/0557; A63B 21/4043; A63B 21/4019; A63B 2225/50; A63B 2225/20

See application file for complete search history.

(56) References Cited

U.S. PATENT DOCUMENTS

| | | | | |
|---|---|---|---|---|
| 28,245 A * | 5/1860 | Anderson | B66F 15/00 | 254/129 |
| 279,467 A * | 6/1883 | Weil | A41B 1/10 | 2/128 |
| 3,741,207 A * | 6/1973 | Fuson | A61F 13/104 | 128/879 |
| 4,541,127 A * | 9/1985 | Gould | A63B 71/143 | 2/161.1 |
| 4,654,895 A * | 4/1987 | Peters | A41D 19/0017 | 2/161.1 |
| 4,671,258 A * | 6/1987 | Barthlome | A61H 1/0288 | 128/DIG. 20 |
| 4,691,387 A * | 9/1987 | Lopez | A41D 19/01547 | 2/159 |
| 5,004,231 A * | 4/1991 | Alread | A63B 21/4019 | 2/159 |

(Continued)

*Primary Examiner* — Garrett K Atkinson

(57) ABSTRACT

Exemplary embodiments of the present disclosure are directed towards a multi-functional exercise device for improving flexibility, range of motion and muscle strength of the user's hands. The exercise device comprising a first band unit comprising a plurality of first spokes, plurality of first spokes connected diametrically opposite to second band unit comprising plurality of second spokes via a central hub, each first spoke provides a means for connecting a first band to central hub and each second spoke provides a means for connecting a second band to the central hub, and a wrist band comprising elongated bands secured to central hub, wrist band comprising an opening configured to wrap around wrist for improved stability and additional base support when both palms are stretched, the central hub comprising a miniature digital counter and a miniature stretch sensor, the miniature stretch sensor electrically coupled to the miniature digital counter.

20 Claims, 5 Drawing Sheets

(56) References Cited

U.S. PATENT DOCUMENTS 5,184,815 A * 2/1993 Maddox ..... A63B 69/0002 2/161.1
5,445,582 A * 8/1995 Brown ..... A63B 23/16 482/124
5,500,956 A * 3/1996 Schulkin ..... A63B 71/148 2/159
5,683,335 A * 11/1997 Groves ..... A43B 19/005 482/105
6,049,910 A * 4/2000 McCarter ..... A63B 71/148 2/161.1
6,213,918 B1 * 4/2001 Rogers, Jr. ..... A63B 21/0004 482/124
6,430,750 B1 * 8/2002 Tourbier ..... A41D 19/001 2/159
6,539,551 B1 * 4/2003 Jones, Jr. ..... A63B 69/3608 2/159
6,604,244 B1 * 8/2003 Leach ..... A41D 19/0055 15/227
7,051,377 B1 * 5/2006 Milner ..... A41D 19/01547 2/159
7,063,646 B1 * 6/2006 Slimi ..... A63B 22/14 482/141
D587,409 S * 2/2009 Raymond ..... D29/117.2
8,092,411 B2 * 1/2012 Betcher ..... A61F 5/0118 128/878
8,641,586 B2 * 2/2014 Bremer ..... A63B 21/00185 482/121
2004/0226074 A1 * 11/2004 Taira ..... A41D 13/0587 2/159
2008/0263747 A1 * 10/2008 DeBlasis ..... A41F 1/06 2/161.1
2010/0234776 A1 * 9/2010 Borden ..... A61H 1/0281 601/33
2011/0118635 A1 * 5/2011 Yamamoto ..... A61H 1/02 601/5
2011/0126342 A1 * 6/2011 Bautista ..... A63B 71/143 2/161.1
2012/0061371 A1 * 3/2012 Broom ..... A63C 11/222 219/211
2012/0167272 A1 * 7/2012 Scaff ..... A61F 5/0118 2/160
2012/0245004 A1 * 9/2012 Bremer ..... A63B 21/00185 482/129
2013/0227760 A1 * 9/2013 Mahon ..... A41D 19/01 2/160
2015/0289576 A1 * 10/2015 Woody ..... A41D 19/0024 2/16
2015/0374053 A1 * 12/2015 Mahon ..... A41D 19/01 2/160
2016/0236031 A1 * 8/2016 Nouri ..... A63B 21/151
2016/0279467 A1 * 9/2016 Dickens ..... A63B 21/072
2016/0361222 A1 * 12/2016 Publicover ..... A63B 21/023
2017/0028245 A1 * 2/2017 Williams ..... A63B 21/0557
2017/0259112 A1 * 9/2017 Davis ..... A61H 1/0237

* cited by examiner

MULTI-FUNCTIONAL EXERCISE DEVICE

TECHNICAL FIELD

The disclosed subject matter relates generally to the field of exercise devices. More particularly, the present disclosure relates to a multi-functional exercise device to improve strengthening, training, flexibility, rehabilitation and range of motion of various muscle groups present in the user's hands.

BACKGROUND

There has been a longstanding need to improve the strength, endurance, dexterity and coordination of the hand and finger muscles. Problems associated with the inability to control finger movements and perform in accordance to the desired tasks have been compounded by the increasing complexity of tasks that unprecedented technological improvements have placed on the human fingers and hands. Resistance training is a common type of strength training for developing the strength of skeletal muscles and tendons. It is possible to strengthen the skeletal muscles by providing resistive exercises over a period of time. Owing to its ubiquitous nature, the use of smart computing devices (computers, smartphones, tablets, video game systems, and so forth) has exponentially increased and has resulted in the constant use and overuse of our hands and fingers. Moreover, the usage of these smart computing devices causes a dramatic increase in repetitive strain injuries such as nerve entrapments, muscle strain, and tendon problems due to lack of hand and finger specific exercises. Other key role players that contribute to overuse of hands are improper or awkward muscle movements during exercises, excessive weight lifting during hand exercises like push-ups (one-handed or using both the hands), constant typing, sewing, causing serious injuries to hand muscles, severe muscle fatigue and/or loss of finger grip etc. Despite the increasing use of technology, there is still a lack of general awareness on the adverse impact of persistent usages of such computing devices on various parts of the human body—i.e., notably, the hands and fingers.

Conventional exercise devices have been developed for fitness, rehabilitation, and therapeutic use. Conventional exercise devices include simple elastic bands which are used for strengthening the skeletal muscles and tendons. However, those devices have been associated with disadvantages including size, and bulkiness. Further, the conventional exercise devices can be very expensive, complex to assemble and cumbersome to use. Moreover, health advisors (physiotherapists, physicians and/or fitness centers, for e.g.) do recommend rest and arm and wrist exercises to strengthen the relevant muscles. But, those exercises don't go far enough or are very general in nature and fail to address issues specific to the user's hand and user's finger muscles or tendons.

In the light of aforementioned discussion there exists a need for a multi-functional exercise device that would overcome the above-mentioned disadvantages.

Unless otherwise indicated herein, the materials described in this section are not prior art to the claims in this application and are not admitted to be prior art by inclusion in this section.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

An objective of the present disclosure is directed towards providing exercise apparatus for exercising hands, finger muscles, and tendons.

Another objective of the present disclosure is directed towards strengthening and stretching the fingers of both hands.

Another objective of the present disclosure is directed towards exercising the user's fingers and user's hands implicated due to the stretching and compression of the exercise apparatus which can have different tension (resistance) values.

Another objective of the present disclosure is directed towards increasing or decreasing the tension (resistance) values by the speed at which the stretching and compression is executed by the user.

An exemplary aspect, an exercise device comprising a first band unit and a second band unit is provided.

According to another exemplary aspect, the first band unit comprising a plurality of first spokes, the plurality of first spokes are connected diametrically opposite to the second band unit comprising a plurality of second spokes via at least one central hub.

According to another exemplary aspect, each first spoke provides a means for connecting at least one first band to the at least one central hub and each second spoke provides a means for connecting at least one second band to the at least one central hub.

According to another exemplary aspect, the exercise device further comprises at least one wrist band comprising at least two elongated bands secured to the at least one central hub, the at least one wrist band comprising at least one opening configured to wrap around the wrist for improved stability and additional base support when both palms are stretched, whereby the at least one central hub comprising at least one miniature digital counter and at least one stretch sensor, the at least one miniature stretch sensor electrically coupled to the at least one miniature digital counter.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
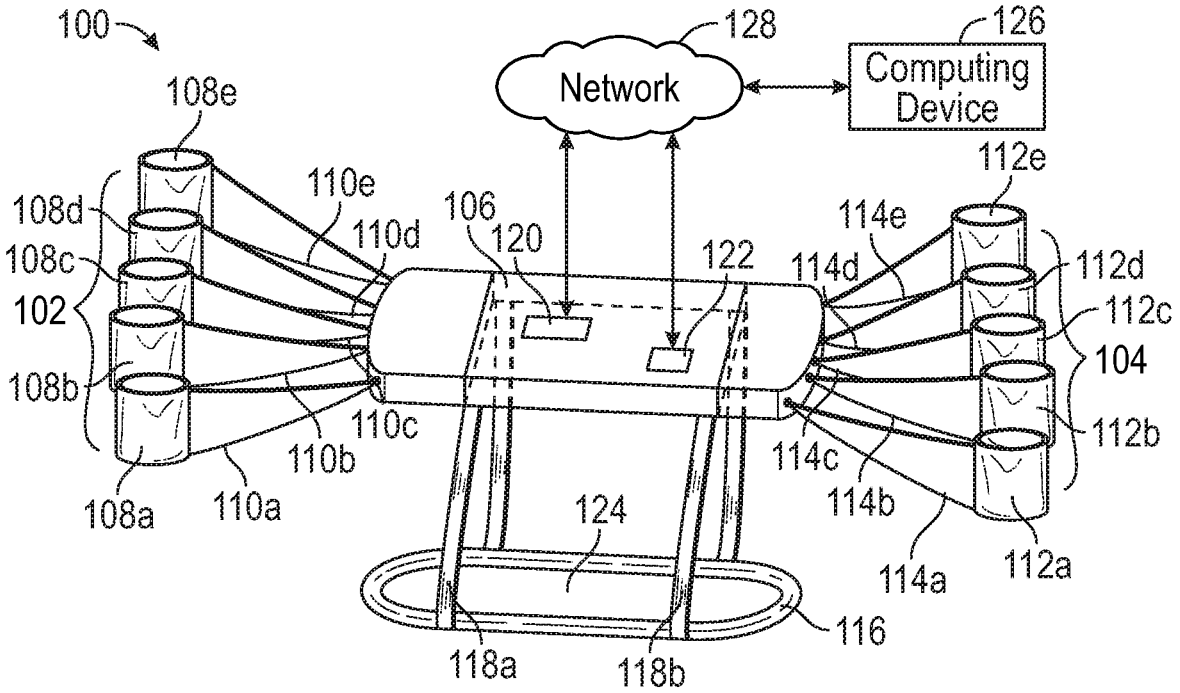
FIG. 1 is a diagram depicting a top view of a multi-functional exercise device, in accordance with one or more exemplary embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The purpose of the exercise device is to simultaneously strengthen and stretch the fingers of both hands. The user's fingers and the user's hands are exercised due to the stretching and compression of the exercise device 100 which in itself can vary in tension (resistance) based on the different colors of the elastic band. Furthermore, the tension (resistance) can also be increased or decreased by the speed at which the stretching and compression is executed by the individual using the exercise device 100.

Referring to FIG. 1 is a diagram 100 depicting a top view of a multi-functional exercise device, in accordance with one or more exemplary embodiments. The multi-functional exercise device 100 includes various components for improving flexibility, range of motion and muscle strength of the user's hands. The multi-functional exercise device 100 preferably includes a first band unit 102, a second band unit 104, and a central hub 106. The first band unit 102 includes first spokes 108*a*, 108*b*, 108*c*, 108*d*, 108*e* and first bands 110*a*, 110*b*, 110*c*, 110*d*, 110*e*. Similarly, the second band unit 104 includes second spokes 112*a*, 112*b*, 112*c*, 112*d*, 112*e* and second bands 114*a*, 114*b*, 114*c*, 114*d*, 114*e*. The first band unit 102 and the second band unit 104 may include but not limited to, a user's left hand finger wrap, a user's right hand finger wrap, and the like. The first spokes 108*a*, 108*b*, 108*c*, 108*d*, 108*e* are connected diametrically opposite to the second band unit 104 comprising second spokes 112*a*, 112*b*, 112*c*, 112*d*, 112*e* via the central hub 106. Each first spoke 108*a*, 108*b*, 108*c*, 108*d*, 108*e* provides a means for connecting a first band 110*a*, 110*b*, 110*c*, 110*d*, and 110*e* to the central hub 106. Similarly, each second spoke 112*a*, 112*b*, 112*c*, 112*d*, 112*e* provides a means for connecting a second band 114*a*, 114*b*, 114*c*, 114*d*, and 114*e* to the central hub 106. The central hub 106 is essentially a square or round elastic pad with reasonable thickness, thereby, allowing for flexing, while still acting as the main link and anchor to the first band unit 102 and the second band unit 104. The first spokes 108*a*, 108*b*, 108*c*, 108*d*, 108*e* and the second spoke 112*a*, 112*b*, 112*c*, 112*d*, 112*e* may be of any length, capable of covering user's fingers.

The multi-functional exercise device 100 further includes a wrist band 116 comprising elongated bands 118*a*, 118*b* secured to the central hub 106. The wrist band 116 comprising an opening 124. The opening 124 is configured to wrap around the wrist for improved stability and additional base support when both palms are stretched. The first bands 110*a*, 110*b*, 110*c*, 110*d*, 110*e*, second bands 114*a*, 114*b*, 114*c*, 114*d*, 114*e*, and elongated bands 118*a*, 118*b* are constructed of soft, and flexible material that provides sufficient durability for the user. The first bands 110*a*, 110*b*, 110*c*, 110*d*, 110*e*, second bands 114*a*, 114*b*, 114*c*, 114*d*, 114*e*, and elongated bands 118*a*, 118*b* include a material which may not be limited to, polyester, cotton, nylon, spandex, fabric, or any combinations thereof, but may also include any material suitable for withstanding the normal operating conditions of the bands (first bands 110*a*, 110*b*, 110*c*, 110*d*, 110*e*, 110*e*, second bands 114*a*, 114*b*, 114*c*, 114*d*, 114*e*, and elongated bands 118*a*,118*b*, for e.g.). The first bands 110*a*, 110*b*, 110*c*, 110*d*, 110*e*, second bands 114*a*, 114*b*, 114*c*, 114*d*, 114*e*, and elongated bands 118*a*, 118*b* come in varying colors denoting different strength or resistance grades. The user's fingers and hands are exercised due to the stretching and compression of the elastic bands (first bands 110*a*, 110*b*, 110*c*, 110*d*, 110*e*, second bands 114*a*, 114*b*, 114*c*, 114*d*, 114*e*, and elongated bands 118*a*, 118*b*, for e.g.) which in itself may vary in tension (resistance) based on the different colors of the elastic band (first bands 110*a*, 110*b*, 110*c*, 110*d*, 110*e*, second bands 114*a*, 114*b*, 114*c*, 114*d*, 114*e*, and elongated bands 118*a*, 118*b*, for e.g.). Furthermore, the tension (resistance) may also be increased or decreased by the speed at which the stretching and compression is executed by the user using such an exercise device.

The central hub 106 includes a miniature stretch sensor 120 and a miniature digital counter 122. The miniature stretch sensor 120 is mechanically connected to the first bands 110*a*, 110*b*, 110*c*, 110*d*, 110*e*, second bands 114*a*, 114*b*, 114*c*, 114*d*, 114*e*, and elongated bands 118*a*, 118*b*, for sensing the band extension and compression information. The miniature stretch sensor 120 is configured to record the band extension and compression information while the user is exercising the his/her fingers and hands. The miniature digital counter 122 which tracks the cycle count of the first bands 110*a*, 110*b*, 110*c*, 110*d*, 110*e* or/and second bands 114*a*, 114*b*, 114*c*, 114*d*, 114*e*, or/and elongated bands 118*a*, 118*b*. The miniature digital counter 122 is operatively connected to the miniature stretch sensor 120 in order to receive either analog or digital signals of the stretch force value recorded in the miniature stretch sensor 120. The miniature stretch sensor 120 is particularly configured to count the number of extensions and compressions, wherein, each extension and compression is assumed to be one cycle. The miniature digital counter 122 is configured to take the force value from the miniature stretch sensor 120 and combines with the cycle count it records and converts to a displayable final resistance force value (in Kgs or lbs, for e.g.). The output value is displayed on the miniature digital counter 122. The central hub 106 further includes a power source configured to operate the miniature stretch sensor 120 and the miniature digital counter 122. The miniature stretch sensor 120 and the miniature digital counter 122 may be connected to a computing device 126 through a network 128. The network may include, but not limited to, cellular network, wireless personal area networks, e.g., Bluetooth wireless networks, wireless local area networks, e.g., Wi-Fi wireless networks, low-rate wireless personal area networks, e.g., Zigbee wireless networks, radiofrequency identification (RFID), ultra-wide band (UWB), etc., or optical communication technologies such as infrared (IR), laser, visible light communication (VLC), etc. The values recorded by the miniature stretch sensor 120 and the miniature digital counter 122 may be transferred via the network 128 to the computing device 126. The computing device 126 represents a device such as personal computer, handheld device, internet enabled calling device, workstation, personal digital assistant, mobile station, mobile phone, computing tablet, and the like.

Figure 2A:
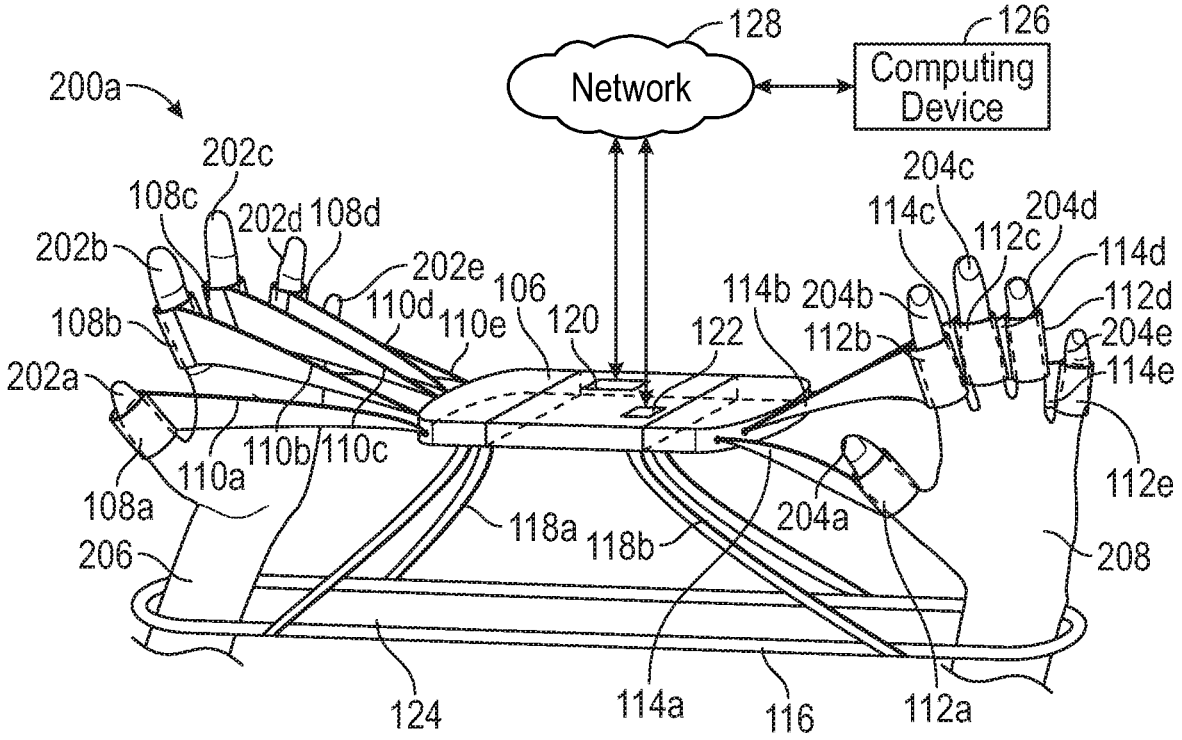
FIG. 2A-2B are diagrams depicting a perspective view of a multi-functional exercise device shown in FIG. 1, in accordance with one or more exemplary embodiments.
Figure 2B:
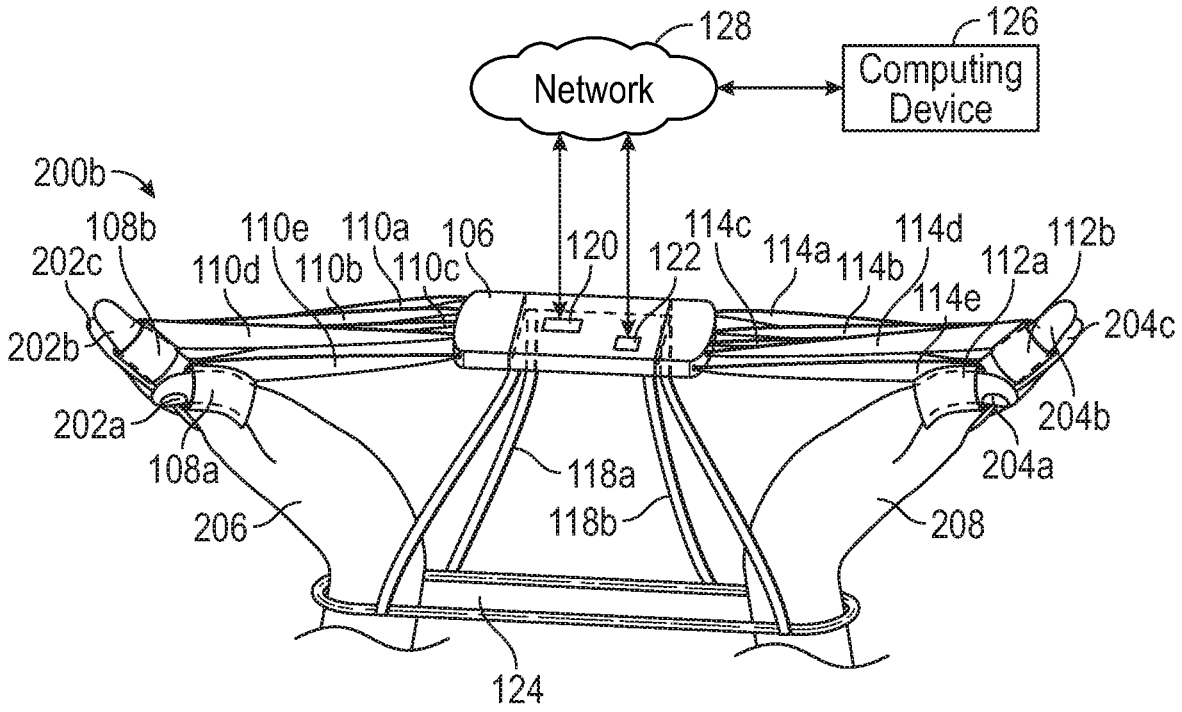

Referring to FIG. 2A-2B are diagrams 200*a*-200*b* depicting a perspective view of a multi-functional exercise device shown in FIG. 1, in accordance with one or more exemplary embodiments. At rest position, the length of the exercise device 100 may be approximately 4 inches to 6 inches. During extension, the first bands 110*a*, 110*b*, 110*c*, 110*d*, 110*e*, second bands 114*a*, 114*b*, 114*c*, 114*d*, 114*e*, and elongated bands 118*a*, 118*b* may be potentially stretched to four to five times the baseline length of exercise device 100, but the exercise device 200*a*-200*b* again depends on the individual's strength capability. The spokes 108*a*, 108*b*, 108*c*, 108*d*, 108*e* (not shown) and 112*a*, 112*b*, 112*c*, 112*d*, 112*e* may be worn by the user to perform various exercises.

As shown in FIG. 2B, the user's fingers 202*a*-202*e*, 204*a*-204*e* and the user's hands 206, 208 are exercised due to the stretching and compression of the exercise device 200 which in itself can vary in tension (resistance) based on the different colors of the first bands 110*a*, 110*b*, 110*c*, 110*d*, 110*e*, the second bands 114*a*, 114*b*, 114*c*, 114*d*, 114*e*, and the elongated bands 118*a*, 118*b*, and the wrist band 116. The force is created by the degree of resistance experienced in each stretch which is recorded as a force value in the miniature stretch sensor 120. The purpose of the digital counter 122 is to count the number of extensions and compressions, wherein, each extension and compression is assumed to be one cycle. The tension (resistance) of the first bands 110*a*, 110*b*, 110*c*, 110*d*, 110*e*, the second bands 114*a*, 114*b*, 114*c*, 114*d*, 114*e*, and the elongated bands 118*a*-118*b* and distance between the central hub 106 and the band units 102-104 may result in varying degree of resistance, flexibility and stretching motion, thereby, providing exercises with different intensities. The miniature stretch sensor 120 and the miniature digital counter 122 may be connected to the computing device 126 through the network 128. The values recorded by the miniature stretch sensor 120 and the miniature digital counter 122 may be transferred via the network 128 to the computing device 126.

Figure 3A:
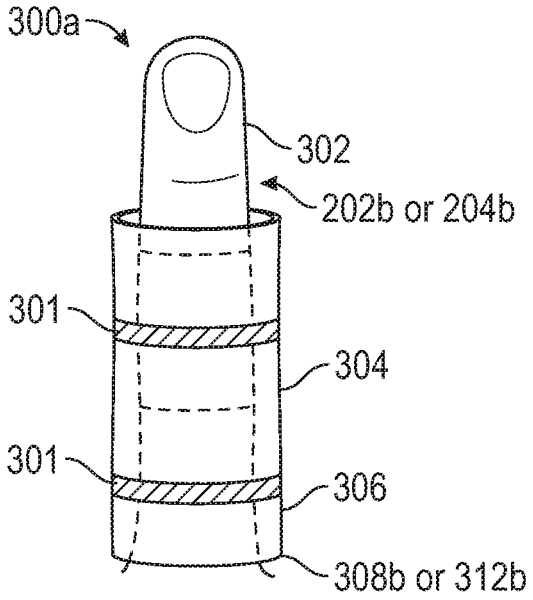
FIG. 3A is a diagram depicting a front view of an index finger 202*b* or 204*b*, in accordance with one or more exemplary embodiments.

Referring to FIG. 3A is a diagram 300*a* depicting a front view of an index finger 202*b* or 204*b*, in accordance with one or more exemplary embodiments. The front view 300*a* depicting a distal phalange 302, a middle or intermediate phalange 304, a proximal phalange 306, and a spoke 308*b* or 312*b*. The spoke 308*b* or 312*b* may be of any length, capable of covering the user's index finger 202*b* or 204*b*. The spoke 308*b* or 312*b* is constructed of soft, flexible materials and various material combinations may be used for the spoke 308*b* or 312*b*. The spoke 308*b* or 312*b* is configured to cover the middle or intermediate phalange 304, and the proximal phalange 306 of the index finger 202*b* or 204*b*. The spoke 308*b* or 312*b* having beadings 301 are positioned at the center of the middle or intermediate phalange 304 and the proximal phalange 306.

Figure 3B:
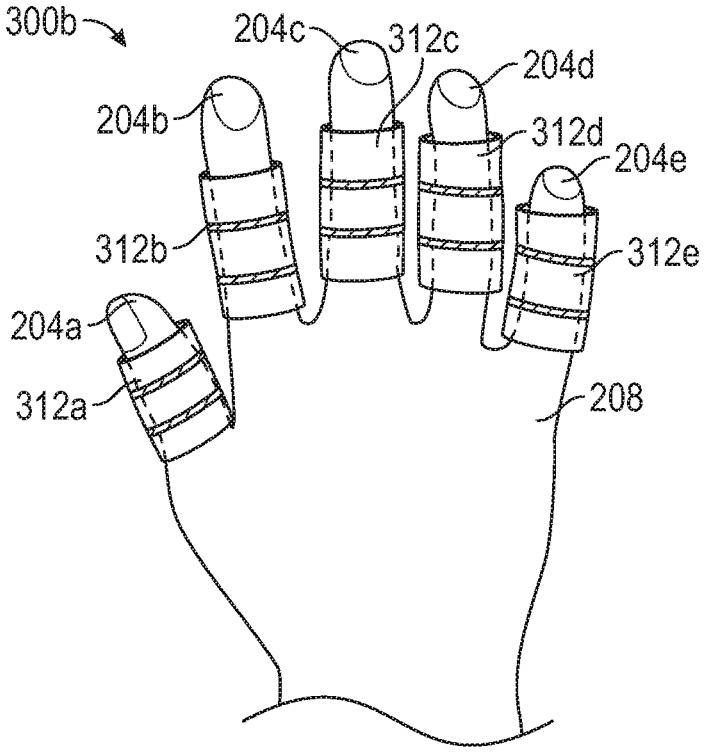
FIG. 3B is a diagram depicting a front view of a user's right hand, in accordance with one or more exemplary embodiments.

Referring to FIG. 3B is a diagram 300*b* depicting a front view of a user's right hand, in accordance with one or more exemplary embodiments. The front view 300*b* depicting the user's right hand 208 having the user's fingers 204*a*, 204*b*, 204*c*, 204*d*, 204*e* include the index finger, the thumb finger, the middle finger, the ring finger and the little finger. The front view of the right hand 300*b* further depicting the spokes 312*a*, 312*b*, 312*c*, 31*d*, and 312*e*. The spokes 312*a*, 312*b*, 312*c*, 31*d*, 312*e* can be detached from the multi-functional exercise device. The spokes 312*a*, 312*b*, 312*c*, 31*d*, 312*e* may be of any length, capable of covering the user's fingers 204*a*, 204*b*, 204*c*, 204*d*, 204*e*. The spokes 312*a*, 312*b*, 312*c*, 312*d*, 312*e* may be constructed of soft, and flexible materials and various material combinations or special performance materials for particular uses or based on user preferences (designer, for e.g.). The spokes 312*a*, 312*b*, 312*c*, 312*d*, 312*e* are configured to cover the thumb finger 204*a*, the index finger 204*b*, the middle finger 204*c*, the ring finger 204*d*, and the little finger 204*e*.

Figure 4:
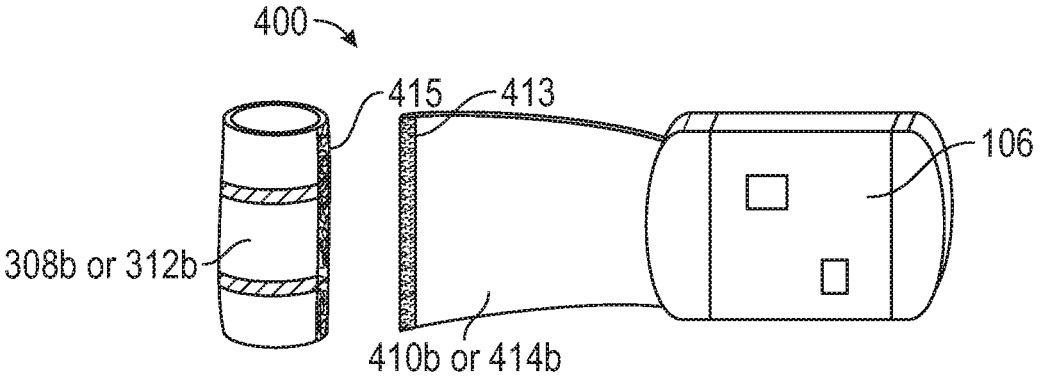
FIG. 4-FIG. 5 are diagrams depicting the front view of a single spoke and a first band or second band, in accordance with one or more exemplary embodiments.
Figure 5:
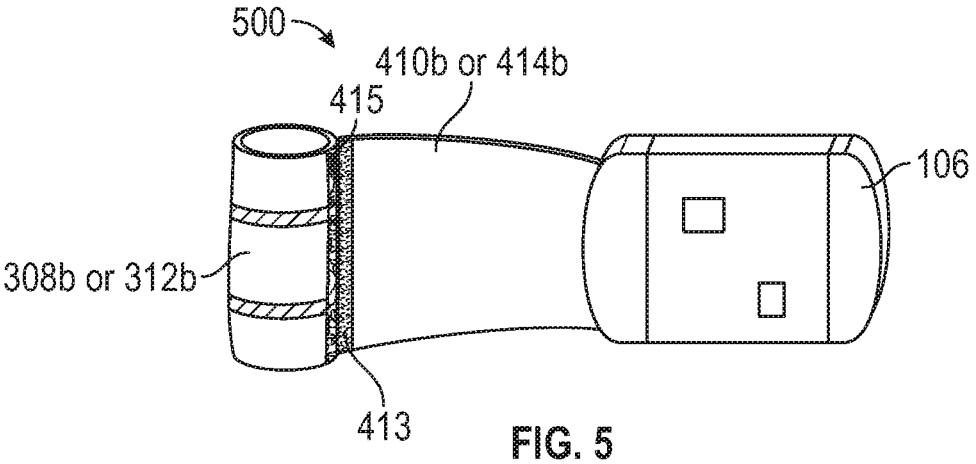

Referring to FIG. 4-FIG. 5 are diagrams 400-500 depicting the front view of a single spoke and a first band or second band, in accordance with one or more exemplary embodiments. The front view 400 depicting the spoke 308*b* or 312*b*, a first band or second band 410*b* or 414*b*, and the central hub 106. The front view 400 further depicting a Velcro female counterpart 415, and a Velcro male counterpart 413. Each spoke 308*b* or 312*b* includes the Velcro female counterpart 404 and the first band or second band 410*b* or 414*b* includes the Velcro male counterpart 406. The spoke 308*b* or 312*b* and the central hub 106 may be fastened by inserting the Velcro male counterpart 413 into the Velcro female counterpart 415 as shown in diagram 500.

Figure 6A:
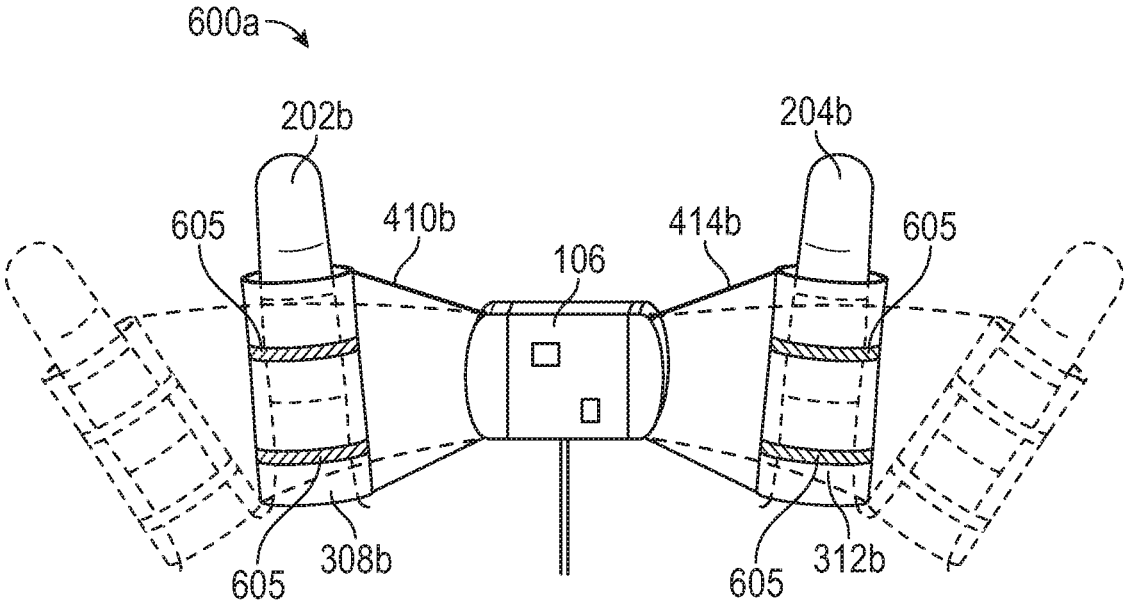
FIG. 6A-FIG. 6B are diagrams depicting another embodiment of the multi-functional exercise device, in accordance with one or more exemplary embodiments.
Figure 6B:
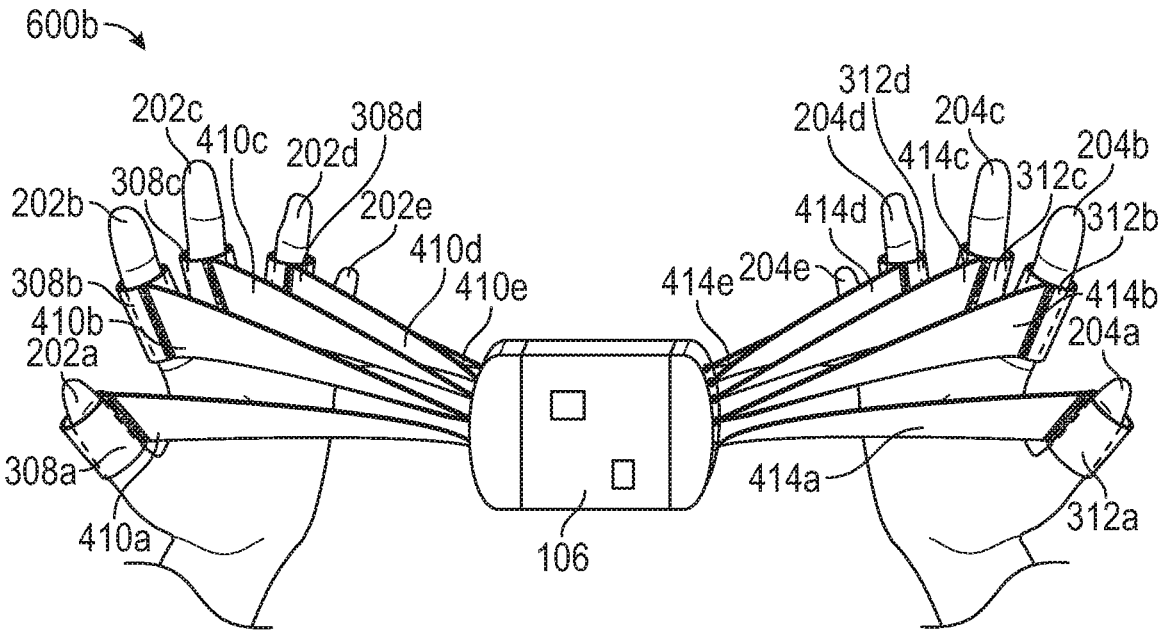

Referring to FIG. 6A-FIG. 6B are diagrams 600*a*-600*b* depicting another embodiment of the multi-functional exercise device, in accordance with one or more exemplary embodiments. More specifically, the diagrams 600*a*-600*b* depicting the front view of a multi-functional exercise device. The diagram 600*a* depicting the fingers 202*b*, 204*b* and the spokes 308*b*, 312*b* and the first and second bands 410*b*, 414*b*. The first and second bands 410*a*, 410*b* may include but are not limited to, Velcro belts, and the like. The fingers 202*b*, 204*b* may include but are not limited to, left index finger, right index finger, left middle finger, right middle finger, left thumb finger, right thumb finger, left little finger, right little finger, and the like. The spokes 308, 312*b* may be attached to the central hub 106. The user can perform finger 202*b* to finger 204*b* exercise after wearing the spokes 308*b*, 312*b* and attaching wore spokes to the central hub 106 through the First or second bands 410*a* or 410*b*. Each spoke 308*b*, 312*b* having the beadings 605 is positioned at the center of the phalanges.

As shown in FIG. 6B, another embodiment of the multi-functional exercise device 600*b* preferably includes the First or second bands 410*a*, 410*b*, 410*c*, 410*d*, 410*e*, 414*a*, 414*b*, 414*c*, 414*d*, 414*e*, the spokes 312*a*, 312*b*, 312*c*, 312*d*, 312*e* (here, not shown), the spokes 308*a*, 308*b*, 308*c*, 308*d*, 308*e* (here, not shown), and the central hub 106. The spokes 312*a*, 312*b*, 312*c*, 312*d*, 312*e* (here, not shown), 308*a*, 308*b*, 308*c*, 308*d*, 308*e* (here, not shown) can be of any length, capable of covering the user's fingers 202*a*, 202*b*, 202*d*, 202*d*, 202*e*, 204*a*, 204*b*, 204*c*, 204*d*, 204*e* in their entirety, or any length in between. The spokes 310, 312, 314, 316 (here, not shown), 308*a*, 308*b*, 308*c*, 308*d*, 308*e* (not shown) may be constructed of soft and flexible materials and various material combinations or special performance materials for particular uses or based on user preferences (designer, for e.g.). The spokes 310, 312, 314, 316 (not shown), 308*a*, 308*b*, 308*c*, 308*d*, 308*e* (not shown) and the central hub 106 may be fastened by the First or second bands 410*a*, 410*b*, 410*c*, 410*d*, 410*e*, 414*a*, 414*b*, 414*c*, 414*d*, 414*e*. The spokes 310, 312, 314, 316 (here, not shown), 308*a*, 308*b*, 308*c*, 308*d*, 308*e* (here, not shown) include Velcro female counterparts and the First or second bands 410*a*, 410*b*, 410*c*, 410*d*, 410*e*, 414*a*, 414*b*, 414*c*, 414*d*, 414*e* include Velcro male counterparts. The user can perform finger exercise without fastening the spokes 312*a*, 312*b*, 312*c*, 312*d*, 312*e* (here, not shown), 308*a*, 308*b*, 308*c*, 308*d*, 308*e* (here, not shown) to the central hub 106. All the spokes 312*a*, 312*b*, 312*c*, 312*d*, 312*e* (here, not shown), the spokes 308*a*, 308*b*, 308*c*, 308*d*, 308*e* (here, not shown) and the First or second bands 410*a*, 410*b*, 410*c*, 410*d*, 410*e*, 414*a*, 414*b*, 414*c*, 414*d*, 414*e* can be detached from the central hub 106. Here, the user may only connect the few spokes 310, 312, 314, 316 (here, not shown), or spokes 308*a*, 308*b*, 308*c*, 308*d*, 308*e* (here, not shown) to the central hub 106 via the First or second bands 410*a*, 410*b*, 410*c*, 410*d*, 410*e*, 414*a*, 414*b*, 414*c*, 414*d*, 414*e* for performing any number of different finger exercises.

Figure 7:
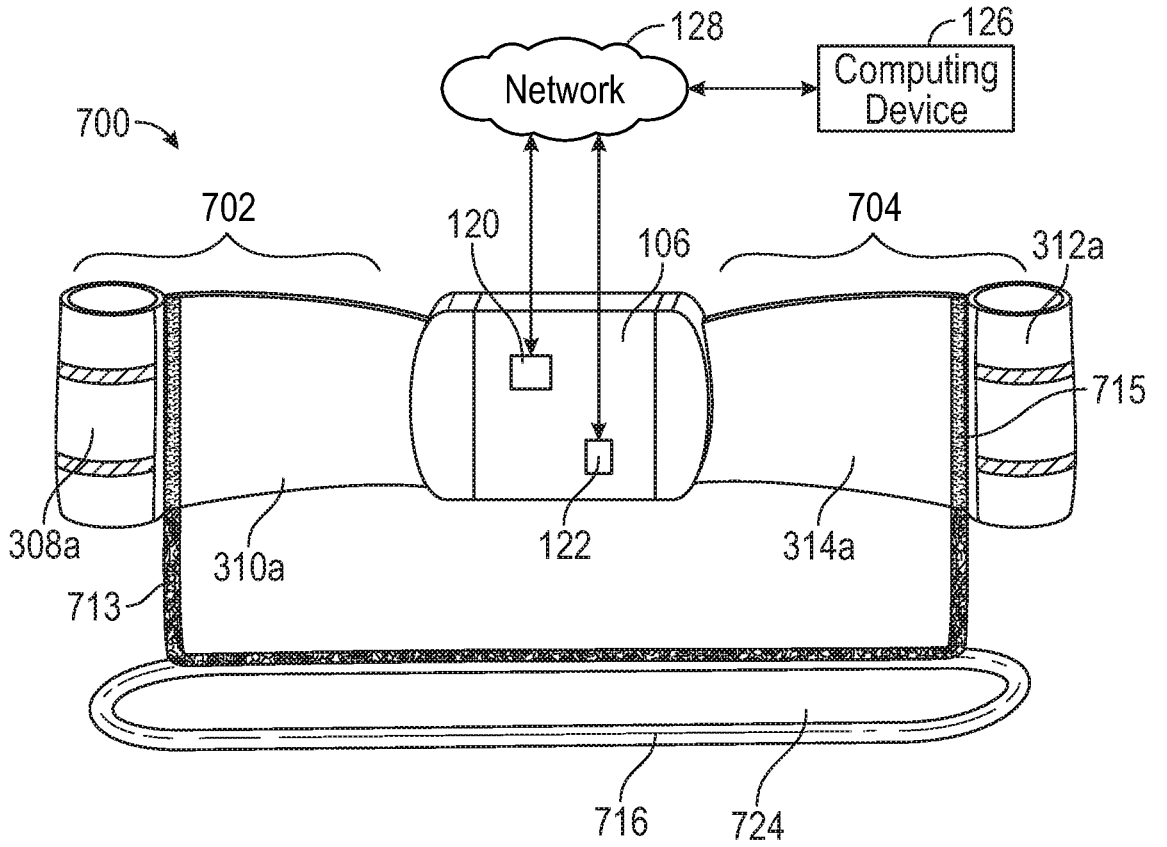
FIG. 7 is a diagram depicting another embodiment of the multifunctional exercise device, in accordance with one or more exemplary embodiments.

Referring to FIG. 7 is a diagram 700 depicting another embodiment of the multifunctional exercise device, in accordance with one or more exemplary embodiments. The multifunctional exercise device depicting the wrist band 716, the first band unit 702, the second band unit 704, and the central hub 106. The first band unit 702 and the second band unit 704 include the spokes 308*a*, 312*a*, and the First or second bands 708, 710. The first band unit 702 and the second band unit 308*a* may also include the spokes (308*a*, 308*b*, 308*c*, 308*d*, 308*e*, 310*a*, 310*b*, 310*c*, 310*d*, and 310*e*) and the bands (410*a*, 410*b*, 410*c*, 410*d*, 410*e*, 414*a*, 414*b*, 414*c*, 414*d*, and 414*e*). The wrist band 716 includes a Velcro male counterpart 713 and a Velcro female counterpart 715 secured to the first band unit 702 and the second band unit 704. The Velcro male counterpart 713 and the Velcro female counterpart 715 may be configured to allow the user for easy attachment and detachment of the wrist band 716 to the first band unit 702 and the second band unit 704. The wrist band 716 may be comprised of a band with hook and loop material. For example, the wrist band 716 is comprised of an elastic material that tightens around the wearer's wrist or include other mechanisms that assist in securing the wrist band 716 to the user's hand. The spokes 308*a*, 312*a*, and the central hub 106 may be fastened by the First or second bands 708, 710. The wrist band 716 comprising an opening 724 configured to wrap around the wrist for improved stability and additional base support when both palms are stretched, the wrist band 716 and the central hub 106 may be detached from the spokes 308*a*, 312*a* (the spokes may also include first spokes 308*a*, 308*b*, 308*c*, 308*d*, 308*e* and the second spokes 312*a*, 312*b*, 312*c*, 312*d*, 312*e*), then the spokes 308*a*, 312*a* (the spokes may also include first spokes 308*a*, 308*b*, 308*c*, 308*d*, 308*e* and the second spokes 312*a*, 312*b*, 312*c*, 312*d*, 312*e*) transform into gloves, the central hub 106 comprising the miniature digital counter 122 and the miniature stretch sensor 120, the miniature stretch sensor 120 electrically coupled to the digital counter 122. If the central hub 106 and the wrist band 716 are detached from the spoke 308*a*, 312*a*, then, the spoke 308*a*-312*a* transforms into a glove which can be used to lift weights or perform any other form of exercise requiring the use of gloves (e.g., moving boxes). The multifunctional exercise device 700 is configured to allow exercise even individual fingers or one set of fingers at any given point in time. The miniature stretch sensor 120 and the miniature digital counter 122 may be connected to the computing device 126 through the network 128. The values recorded by the miniature stretch sensor 120 and the miniature digital counter 122 may be transferred via the network 128 to the computing device 126.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An exercise device comprising:

a first band unit comprising a plurality of first spokes, whereby the plurality of first spokes connected diametrically opposite to a second band unit comprising a plurality of second spokes via at least one central hub, each first spoke provides a means for connecting at least one first band to the at least one central hub and each second spoke provides a means for connecting at least one second band to the at least one central hub; and at least one wrist band comprising at least two elongated bands secured to the at least one central hub, the at least one wrist band comprising at least one opening configured to wrap around the wrist for improved stability and additional base support when both palms are stretched, whereby the at least one central hub comprising at least one miniature digital counter and at least one stretch sensor, the at least one stretch sensor electrically coupled to the at least one miniature digital counter.

2. The exercise device of claim 1, wherein the plurality of first bands, the plurality of second bands, and the at least two elongated bands come in varying colors denoting different strength or resistance grades.

3. The exercise device of claim 1, wherein each first spoke comprising at least two openings for wrapping the at least one finger of the user's first hand.

4. The exercise device of claim 1, wherein each second spoke comprising at least two openings for wrapping the at least one finger of the user's second hand.

5. The exercise device of claim 1, wherein each spoke is configured to cover proximal and middle phalanges of each finger.

6. The exercise device of claim 1, wherein each spoke is independent to other spoke and is configured to allow for greater flexibility and extension of each finger.

7. The exercise device of claim 1, wherein the plurality of first bands, the plurality of second bands, and the at least two elongated bands are configured to allow the user to perform various user's finger exercises and user's hand exercises.

8. The exercise device of claim 1, wherein the plurality of first bands, the plurality of second bands, and the at least two elongated bands which in itself varies in tension based on the different colors of the plurality of first bands, the plurality of second bands, and the at least two elongated bands.

9. The exercise device of claim 1, wherein the at least one miniature stretch sensor is configured to record the plurality of first bands, the plurality of second bands, and the at least two elongated bands extension and compression information while the user is exercising the user's fingers and the user's hands.

10. The exercise device of claim 1, wherein the at least one miniature digital counter is configured to track the cycle count of the plurality of first bands, the plurality of second bands, and the at least two elongated bands.

11. The exercise device of claim 1, wherein the at least one miniature digital counter is operatively connected to the miniature stretch sensor in order to receive either analog or digital signals of the stretch force value recorded in the miniature stretch sensor.

12. The exercise device of claim 1, wherein the at least one miniature stretch sensor and the at least one miniature digital counter are connected to at least one computing device via a network and the recorded values transfer to the computing device via the network.

13. An exercise device comprising:

a first band unit comprising a plurality of first spokes, whereby the plurality of first spokes connected diametrically opposite to a second band unit comprising a plurality of second spokes via at least one central hub, each first spoke provides a means for connecting at least one first band to the at least one central hub and each second spoke provides a means for connecting at least one second band to the at least one central hub; and at least one wrist band comprising at least one male counterpart and at least one female counterpart secured to the first band unit and the second band unit, the at least one wrist band comprising at least one opening configured to wrap around the wrist for improved stability and additional base support when both palms are stretched, the at least one wrist band and the at least one central hub detached from the plurality of first and second spokes, then the plurality of first and second spokes, transform into gloves, whereby the at least one central hub comprising at least one miniature digital counter and at least one stretch sensor, the at least one stretch sensor electrically coupled to the at least one miniature digital counter.

14. The exercise device of claim 13, wherein the plurality of first bands and the plurality of second bands comprising a plurality of hook-and-loop belts.

15. The exercise device of claim 13, wherein the at least one male counterpart and at least one female counterpart configured to allow the user for easy attachment and detachment of the at least one wrist band to the first band unit and the second band unit.

16. The exercise device of claim 13, wherein each spoke is configured to cover the middle or intermediate phalange, proximal phalange of each finger.

17. The exercise device of claim 13, wherein each spoke is having beadings positioned between the center of the phalanges.

18. The exercise device of claim 13, wherein the plurality of first spokes and the plurality of second spokes are connected to the at least one central hub via a plurality of first bands and a plurality of second bands and are detached based on function and need.

19. The exercise device of claim 13, wherein each spoke comprising a Velcro female counterpart and each band comprising a hook-an-loop male counterpart.

20. The exercise device of claim 18, wherein the plurality of first spokes and the plurality of second spokes and the central hub are fastened by inserting the Velcro male counterpart into the hook-and-loop female counterpart.

* * * * *